US005820708A

United States Patent [19]

Jarrett

[11] Patent Number: 5,820,708

[45] Date of Patent: Oct. 13, 1998

[54] PRODUCTION OF EXTRUDED ALUMINUM-LITHIUM ALLOYS

[75] Inventor: Martin Roy Jarrett, Cumbria, Great Britain

[73] Assignee: Alcan International Limited, Montreal, Canada

[21] Appl. No.: 532,793

[22] PCT Filed: Apr. 21, 1994

[86] PCT No.: PCT/GB94/00850

§ 371 Date: Oct. 17, 1995

§ 102(e) Date: Oct. 17, 1995

[87] PCT Pub. No.: WO94/24329

PCT Pub. Date: Oct. 27, 1994

[30] Foreign Application Priority Data

Apr. 21, 1993 [GB] United Kingdom ..... 9308171

[51] Int. Cl.[6] ..... C22F 1/057

[52] U.S. Cl. ..... 148/689; 148/690

[58] Field of Search ..... 148/689, 690, 148/417, 439; 420/532, 533

[56] References Cited

U.S. PATENT DOCUMENTS

| | | | |
|---|---|---|---|
| 5,413,650 | 5/1995 | Jarrett et al. | 148/690 |
| 5,447,583 | 9/1995 | Arthur et al. | 148/689 |
| 5,520,754 | 5/1996 | Yaney et al. | 198/690 |

FOREIGN PATENT DOCUMENTS

| | | | |
|---|---|---|---|
| 0 090 583 | 10/1983 | European Pat. Off. . | |
| 0 325 937 | 8/1989 | European Pat. Off. . | |
| 0 412 204 | 2/1991 | European Pat. Off. . | |
| 64-25954 | 1/1989 | Japan | 148/690 |
| 5-145919 | 5/1994 | Japan | 148/689 |
| 6-145918 | 5/1994 | Japan | 148/689 |
| 89/01531 | 2/1989 | WIPO . | |
| 92/12269 | 7/1992 | WIPO . | |

*Primary Examiner*—George Wyszomierski
*Attorney, Agent, or Firm*—Browdy and Neimark

[57] ABSTRACT

This invention relates to the extrusion of aluminium-lithium alloys, desirably in the form of relatively thin sections, which are particularly suitable for aerospace applications. The invention provides a method of extruding a lithium-containing aluminium alloy containing at least 0.1% by weight of copper, which method comprises: a) providing a billet of the alloy in an homogenised condition at a temperature suitable for extrusion, wherein the alloy contains at least 1.5% by weight of lithium, b) extruding the billet at a temperature and at an extrusion rate such that essentially all of the components thereof are in solid solution as the extrudate leaves the extrusion die, and c) cooling the extrudate at a rate sufficient to avoid substantially any precipitation of the components thereof taking place. Corrosion of the extruded sections after quenching and after ageing can be substantially reduced by means of the present invention.

19 Claims, 1 Drawing Sheet

PRODUCTION OF EXTRUDED ALUMINUM-LITHIUM ALLOYS

Figure 1:
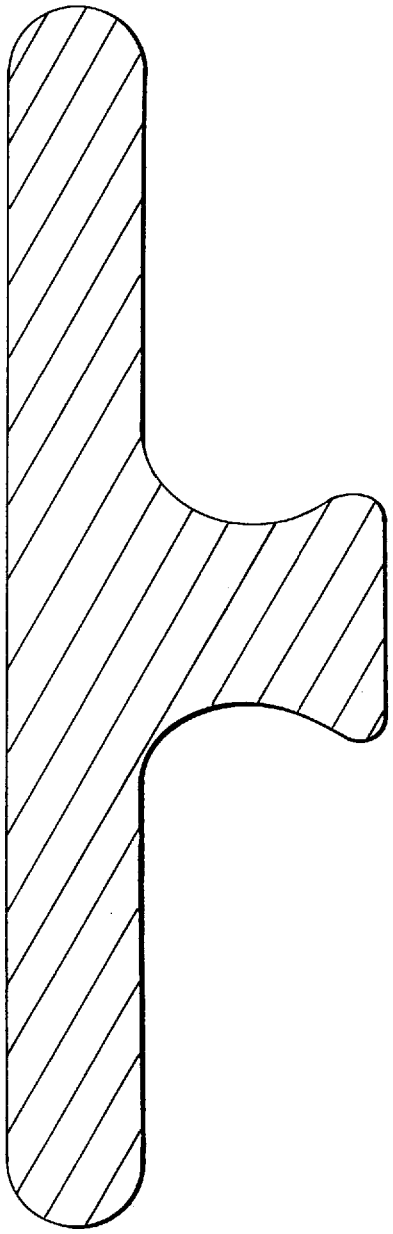

This invention relates to the extrusion of aluminium-lithium alloys, desirably in the form of relatively thin sections, which are particularly suitable for aerospace applications.

Conventionally extrusions in aerospace aluminium alloys are produced by extruding an homogenised and pre-heated billet to the required section. After cooling the extrudate is cut into appropriate lengths (in order to be accommodated in the solution treatment furnace) and heated to a suitable temperature and for a sufficient time to take the soluble alloy additions into solid solution. The section is then water quenched in order to retain the alloying additions in supersaturated solid solution at ambient temperature. This conventional treatment is known as a "formal solution treatment", and the temperature at which this treatment is carried out is referred to herein as "the solution treatment temperature".

A variety of furnaces can be used to achieve the solutionising step but, most commonly, large air furnaces are used in which the extruded sections are suspended vertically, the furnace being mounted directly over a water quench tank. When the sections have been heated for the appropriate time the bottom of the furnace is opened and the sections are rapidly lowered into the quench tank to achieve rapid and uniform quenching. After drying the sections are stretched, frequently by a controlled amount in order to give optimum strength properties in the final product and to rectify distortions arising from the solution treatment. The stretched extrusion would generally then be subjected to an ageing treatment at a relatively low temperature in order to develop the required strength properties.

In the case of commercial aluminium alloys required for less demanding applications than aerospace, the above procedure is frequently simplified. The commercial alloys tend to have much lower sensitivity to quench rate than the aerospace alloys and, in any case, the property demands are less. Thus the separate steps of cutting to length, solutionising and water quenching are omitted and the hot section is passed directly into a quench tank as soon as possible after it emerges from the extrusion die.

This so-called "press quenched" extrusion is then simply stretched and aged. These simplified procedures have, traditionally, been forbidden for structural aerospace alloys because of the requirements to achieve demanding strength property combinations and the necessity for the extrudate to possess uniformity in such properties.

In the last decade or so very great efforts have been devoted to the development of lower density aerospace aluminium alloys by the addition of lithium (in combination with a variety of other additions). To achieve worthwhile density reductions it is desirable for the lithium addition to be of the order of 2 to 2½ wt % which equates to about 10 to 13 at %. While this produces highly desirable effects in reducing the density and increasing the elastic modulus it also has some disadvantages. In particular, because the lithium atom is very small it can, at elevated temperatures, diffuse quite rapidly from the core of the material to the surface. At the surface it will, because of its high reactivity, rapidly oxidise. If any water, or water vapour, is present the oxide will be converted into lithium hydroxide which will rapidly attack the metal surface upon which it has formed. This can, very quickly, result in serious corrosive attack of the metal substrate, frequently to the extent that the product is unsaleable. Corrosion pitting is a particular problem in relatively thin sections. The migration of the lithium to the surface also creates a lithium-depleted surface layer, and the greater the time for which the extrusion is exposed to elevated temperatures the greater the extent of lithium depletion. In addition then to the considerable potential for corrosive attack, there is added the further drawback of a loss of strength potential as a consequence of the local loss of lithium. This will have the further disadvantage of increasing the density of the remaining metal.

With extruded aluminium-lithium alloys the structure is largely unrecrystallised. This results in an increase in strength properties in the longitudinal direction as a consequence of the crystallographic preferred orientation developed by the extrusion process (the so-called "extrusion effect"). It also results in an improved response to subsequent precipitation treatments because of the presence of large numbers of dislocations in the form of a dislocation sub-structure giving additional sites for precipitation and a better distribution of the strengthening phases. Any thermal treatment, such as the solution treatment, will tend to annihilate some of the dislocation substructure and also to cause a certain amount of recrystallisation. Both of these effects will combine further to reduce the strength potential of the extrudate.

Using the conventional manufacturing route, described above, for the manufacture of aluminium-lithium extrusions the Applicants found that the extrudate frequently had a severely corroded surface. Many attempts were made to try to eliminate this corrosion. One line of reasoning lead the Applicants to conclude that lithium was migrating to the surface during the solutionising step, being converted to hydroxide during the water quench, and that failure to remove, rinse and dry the quenched extrusion sufficiently rapidly was allowing post-solution treatment corrosion to occur. However, no matter how rapidly these steps were performed the Applicants failed to eliminate this corrosion. After further investigation it was surprisingly realised that in fact the corrosion was occurring during the heating up period in the solutionising furnace. Because these furnaces are normally of the "drop-bottom" type, copious quantities of steam are generated immediately beneath the furnace as the extruded sections are quenched. The steam rushes into the furnace and by the time that the next batch of extruded sections are charged the furnace atmosphere still contains a relatively high proportion of water vapour. This condenses onto the cold surface of the newly introduced sections and converts any lithium oxide on the fresh surfaces, resulting from the hot extrusion process, into lithium hydroxide which, at the elevated temperature of the furnace, results in particularly rapid attack of the substrate. Thus no matter how rapidly the material is removed from the quench tank or how quickly and carefully it may be dried, no reduction in the corrosive attack can be achieved.

Various means have been described in the prior art to alleviate the problems of lithium migration and corrosion pitting that occur when a formal solution treatment step is used. One solution proposed by the proprietors of U.S. Pat. No. 5,061,328 consists of coating the exposed surface of the alloy prior to heat treatment with an element, such as gold, having a diffusion coefficient equal to or greater than that of lithium at the heat treatment temperature. The use of such a coating is, however, expensive in terms of both materials and additional processing steps.

Another approach is to utilise a protective atmosphere during the heat treatment step, such as a mixture of carbon dioxide and water vapour as described in GB-A-2,137,666. Again, however, some surface degradation and lithium loss was found to occur.

A successful technique proposed by the Applicants which has been found to prevent this corrosion utilises an organic, high boiling point oil which is applied to the surface prior to solution treatment and burns off as the extrudate is heated. However, while the extrudate is cold and therefore susceptible to the condensation thereon of water vapour, the oil protects the surface from such condensation, and attack is thereby prevented. While this technique works satisfactorily in largely eliminating the corrosion problem, it is a relatively labour intensive procedure and does not eliminate the lithium depletion that occurs as a consequence of the extrudate being held at the relatively high temperature of the solution treatment furnace, and nor does it eliminate recrystallisation and/or recovery from occurring which tends to reduce the final strength properties of the extruded material.

Equally solution treatment in a salt bath is possible and this means that the extrudate has no contact with water vapour during the critical heating-up period. However, again, lithium depletion will occur with the inevitable concomitant loss of strength properties and increase in density, as well as creating the opportunity for recrystallisation and/or recovery to take place.

There is therefore a need for a method which is capable of producing extruded material with reduced surface corrosion whilst avoiding substantial loss of lithium from the alloy.

The Applicants have now established that, within appropriate compositional limits, it is possible both to overcome the above-described problems of corrosion and to provide an extrudate of considerably improved surface appearance while simultaneously both minimising the lithium depleted layer with its concomitant disadvantages and minimising recrystallisation effects with their strength disadvantages. The technique by which this is achieved is first to select a basic composition which confers low quenching sensitivity on the alloy. A billet of this composition is then extruded under conditions that ensure that the alloying additions are taken fully into solid solution during extrusion process which takes place under conditions which ensure that the alloying additions remain in solid solution. Because the alloy composition has been selected for low quench sensitivity, this solid solution can be maintained in the extrudate during quench, for example by passing it directly through a water tank located near to the extrusion die to quickly effect quenching following extrusion. In a commercial extrusion press the distance between the water tank and the extrusion die could be of the order of 2 to 3 meters. Since the emerging extrudate is above the solvus temperature there will be no possibility of water vapour condensing on its surface. The extrudate is only at this temperature for a very short time before being very rapidly cooled in the quench tank, thus minimising the time for lithium migration, for surface oxide/hydroxide formation, and for recrystallisation and/or recovery processes to occur. The result is a fully solution-treated extrusion of high quality, with an essentially, i.e. substantially corrosion-free surface, with less distortion than results from a separate solution treatment operation, and in a condition ready for stretching and ageing to final strength properties.

In a Paper published in Materials Science and Technology, September 1988, vol. 4 pages 816 to 823, the Authors, N. C. Parson and T. Sheppard describe how they characterise the hot deformation behaviour of an Al—Li—Mg—Zr alloy in hot torsion and extrusion. In particular, they found that it was possible to press quench Al—Li—Mg alloys which contained no copper and obtain good proof strength. FIG. 12 of their Paper shows that the T5 and T6 conditions for the tested alloy had virtually identical proof strengths. "T5" is the designation given to material which is quenched at the press and then aged, while "T6" means that there has been a full formal solution treatment before peak ageing. The Paper does not mention, however, the fracture toughness, ductility, ultimate tensile strength or corrosion resistance of the extruded alloy in the T5 condition, all of which properties are of vital importance in aerospace applications. Thus it is not clear from this Paper that material suitable for aerospace applications was obtained by the Authors.

The Paper by Parson and Sheppard is based on work carried out by Dr. Parson for a PhD at Imperial College of Science and Technology in London, and is more fully reported in his Thesis. In that Thesis, Dr. Parson examined an Al—Li—Mg alloy containing nominally 1.0% Cu by weight and found that it exhibited a different behaviour from the Cu-free alloy described in his Paper with Sheppard. With this Cu-containing alloy, the T5 properties were reported to be substantially lower than the T6 properties, and Dr. Parson commented in his Thesis that the effect of the added copper was either to make the achievement of complete solid solution of all of the components of the alloy on exiting the extrusion die more difficult, or to render the resultant alloy too quench sensitive for his processing conditions. Thus even with the small, easily controlled, experimental extrusion apparatus used by Dr. Parson, he found that it was not possible to get good T5 properties with Cu-bearing Al—Li—Mg alloys. The present invention therefore seeks to provide a method of overcoming this problem.

In accordance with the present invention there is provided, a method of extruding a lithium-containing aluminium alloy containing at least 0.1%, and preferably at least 0.5%, by weight of copper, which method comprises:

a) providing a billet of the alloy in an homogenised condition at a temperature suitable for extrusion, wherein the alloy contains at least 1.5% by weight of lithium, b) extruding the billet at a temperature and at an extrusion rate such that essentially all of the components thereof are in solid solution as the extrudate leaves the extrusion die, and c) cooling the extrudate at a rate sufficient to avoid substantially any precipitation of the components thereof taking place.

The present invention also provides an extrusion of a lithium and copper-containing aluminium alloy when produced by this method, desirably having a substantially unrecrystallised structure.

Preferably the alloy contains from 1.5% to 10% by weight of lithium with the most preferred alloys having the composition in weight percent:

| | |
|---|---|
| lithium | 1.7 to 2.8 |
| magnesium | 0 to 1.9 |

Using this method extrudate can be produced having either a recrystallised or an unrecrystallised structure. A recrystallised structure may be preferred when it is important to obtain more isotropic mechanical properties, possibly at the expense of mechanical strength. Recrystallisation is encouraged by a reduction in the amount of grain controlling element, e.g. by keeping the Zr level below about 0.06% by weight. Recrystallisation may also be brought about by ensuring that the temperature of the extrusion as it leaves the die is kept high, for example by using a high preheat temperature for the extrusion billet or by extruding at a high speed. In practice combinations of these measures may be required to achieve a fully recrystallised extrudate.

By operating at an extrusion temperature (i.e. the temperature of the extrudate as it leaves the die) greater than the solvus temperature of the alloy, a substantially unrecrystallised structure can be produced. An alloy such as 8090, whose melting point is very much higher than its solvus temperature, provides a relatively wide "window" of possible extrusion temperatures. At extrusion temperatures of between 520° and 540° C. extrusion rates of up to 17 m/min can be achieved.

A preferred homogenising treatment is to heat the billet slowly, i.e. less than about 50° C./hour and more preferably less than about 20° C./hour, from 480° C. to between 540° and 550° C. The billet is held in this temperature range for 24 hours or more, and is then cooled to room temperature. Air cooling may be used.

Immediately prior to extrusion, the homogenised billet is preferably heated to 490° to 540° C. and inserted into the preheated press container. Billet heating may be by induction heating or in a gas fired furnace.

Rapid cooling of the extrudate with forced air or water sprays, or combinations of the two, immediately after extrusion, rather than immersion in water, is also to be regarded as "press quenching" within the context of the present invention, but quenching by water immersion is preferred.

Quenching with a jet of cool air will tend to leave in the extrudate less undesirable stress than quenching with water, but the quenching effect is slower with air. Thus there is a preference for water quenching for the relatively thicker sections.

Direct or indirect extrusion can be used, and the extruded material produced can be subjected to a conventional ageing step in order to produce the required mechanical properties.

Embodiments of the present invention will now be described by way of example.

EXAMPLES 1 to 5

Five 183 mm diameter, DC cast billets of 8090 alloy were homogenised by heating from 480° C. to 540° C. at a rate of 20° C. per hour and holding at this temperature for 24 hours before air cooling to room temperature. The billets were then heated to the reheat temperature and held for 1 hour before insertion into a preheated container and extruded in an indirect extrusion press in the form of relatively thin sections. The sections were passed through a standing wave water quench positioned 3 meters from the extrusion die. The extrusion conditions and the principle characteristics of the extrusions thus formed are set out below in Table 1.

Examples 1 to 4 were extruded on a 1600 tone indirect press having a container diameter of 190 mm. Example 5 was extruded on a 5000 tonne direct press having a container diameter of 418 mm. The cross-sectional profile of the extrudate of Example 5 is shown in accompanying FIG. 1, the tensile test sample being taken from the thickest portion of the extrudate.

TABLE 1

| Extrusion Conditions | Example 1 | Example 2 | Example 3 | Example 4 | Example 5 |
|---|---|---|---|---|---|
| Billet Temp. (°C.) | 540 | 540 | 540 | 540 | 540 |
| Container Temp. (°C.) | 400 | 400 | 380 | 380 | 480 |

TABLE 1-continued

| Extrusion Conditions | Example 1 | Example 2 | Example 3 | Example 4 | Example 5 |
|---|---|---|---|---|---|
| Plug Temp. (°C.) | 400 | 395 | 380 | 3.80 | n/a |
| Extrusion Speed (m/min) | 7.0–8.5 | 10–12 | 8.5–9.0 | 6.7–7.6 | 4 |
| Temp. into Quench (°C.) | 510–530 | 510–530 | 510–530 | 495–510 | 495–515 |
| Time into Quench (secs.) | 22 | 16 | 20 | 30 | 60 |
| Temp. after Quench (°C.) | Ambient | Ambient | Ambient | Ambient | Ambient |
| Principle Section Thickness (mm) | 1.8 | 1.5–1.6 | 1.8 | 12.7 | 68 max. 23 min. |
| Section Weight Per Meter (Kg/m) | 0.380 | 0.326 | 0.283 | 3.691 | 18.824 |
| Cross Sectional Area ($cm^2$) | 1.501 | 1.290 | 1.120 | 14.59 | 66.99 |
| 0.2% Proof Stress (MPa) | 404 | 416 | 413 | 497 | 402 |
| U.T.S. (MPa) | 477 | 483 | 486 | 544 | 473 |
| Elongation (%) | 6.0 | 5.4 | 7.1 | 5.3 | 5.4 |
| Section shape | Flat Strip | Tee | Angle | Angle | See FIG. 1 |

All of the sections were stretched 1.5 to 3% after press quenching and then aged at 210° C. for 4.5 hours. Their mechanical properties were determined using longitudinal tensile tests in the T8511 condition.

Resistance to exfoliation corrosion was also determined and in each case was found to be equivalent to class EA/EB.

There was no corrosion of the sections after quenching and ageing.

The advantages of the method of the present invention are:

(a) reduced distortion of extrusions when of a relatively thin cross-section as compared to product of the same thickness formed by conventional practice which includes a formal solution treatment, (b) the ability to produce satisfactory relatively thin sections, e.g. of a thickness less than 2.5 mm, preferably 0.4 mm to 1.0 mm, (c) the capability of producing relatively thick sections, e.g. of a thickness of at least 5 mm, for example at least 15 mm, and for certain alloys such as AA 8090 alloy up to 90 mm, (d) the ready adaptability of the method to a wide range of lithium and copper-containing aluminium alloys, (e) the avoidance of the corrosion that occurs with formal solution treatments, and (f) the achievement of strength properties for extrusions of a quality and a reliability heretofore considered to be possible only with formal solution treatments.

I claim:

1. A method of extruding a lithium-containing aluminum alloy having the composition in weight percent:

| | |
|---|---|
| lithium | 1.7 to 2.8 |
| magnesium | 0 to 1.9 |
| copper | 1.0 to 3.0 |
| manganese | 0 to 0.9 |
| zirconium | 0 to 0.25 |
| at least one other grain-controlling element | 0 to 0.5 |
| nickel | 0 to 0.5 |
| zinc | 0 to 0.5 |
| aluminum | balance (except for incidental impurities) |

wherein the other grain-controlling elements are selected from the group consisting of hafnium, niobium, scandium, cerium, chromium, titanium and vanadium, and wherein at least one of (i) manganese, (ii) zirconium, and (iii) one of the said other grain controlling elements is present, which method comprises:

(a) providing a billet of the alloy in an homogenized condition at a temperature suitable for extrusion, (b) extruding the billet at a temperature and at an extrusion rate such that essentially all of the components thereof are in solid solution as the extruded billet leaves the extrusion die, and (c) quenching the extruded billet with water down from its extrusion temperature to below its solvus temperature in the absence of any intermediate step at a rate sufficient to avoid substantially any precipitation of the components thereof taking place, thereby obtaining an extruded and quenched billet which is substantially corrosion-free.

2. A method as claimed in claim 1, wherein the alloy has a composition within the limits of the registered alloys AA 8090 or AA 8091.

3. A method as claimed in claim 2, wherein the cooling is effected by immersion in water.

4. A method as claimed in claim 3 including the step of ageing the extruded and quenched billet.

5. A method as claimed in claim 2 including the step of ageing the extruded and quenched billet.

6. A method as claimed in claim 2, wherein the extrusion temperature is between 520° and 540° C. and the extrusion rate is up to 17 m/min.

7. A method as claimed in claim 1, wherein the cooling is effected by a water quench.

8. A method as claimed in claim 7 including the step of ageing the extruded and quenched billet.

9. A method as claimed in claim 8, wherein the extrudate has a thickness of up to 90 mm.

10. A method as claimed in claim 9, wherein the extrusion temperature is between 520° and 540° C. and the extrusion rate is up to 17 m/min.

11. A method as claimed in claim 7, wherein the extrusion temperature is between 520° and 540° C. and the extrusion rate is up to 17 m/min.

12. A method as claimed in claim 1 including the step of ageing the extruded and quenched billet.

13. A method as claimed in claim 12, wherein the extrusion temperature is between 520° and 540° C. and the extrusion rate is up to 17 m/min.

14. A method as claimed in claim 1, wherein the extruded billet has a thickness of up to 90 mm.

15. A method as claimed in claim 14, wherein the extruded billet thickness is up to 35 mm.

16. A method as claimed in claim 15, wherein the extruded billet thickness is up to 15 mm.

17. A method as claimed in claim 16, wherein the extruded billet thickness is from 0.4 to 5.0 mm.

18. A method as claimed in claim 17, wherein the extruded billet thickness is from 0.4 to 1 mm.

19. A method as claimed in claim 1, wherein the extrusion temperature is between 520° and 540° C. and the extrusion rate is up to 17 m/min.

* * * * *

UNITED STATES PATENT AND TRADEMARK OFFICE

CERTIFICATE OF CORRECTION

PATENT NO. : 5,820,708

DATED : October 13, 1998

INVENTOR(S) : Martin Roy Jarrett

It is certified that error appears in the above-identified patent and that said Letters Patent is hereby corrected as shown below:

Column 4, between lines 49 and 50, insert --FIG. 1 is a cross-sectional profile corresponding to an extrudate made according to Example 5.--.

Signed and Sealed this

Sixteenth Day of March, 1999

*Attest:*

*Attesting Officer*

Q. TODD DICKINSON

*Acting Commissioner of Patents and Trademarks*